United States Patent [19]

Broadhurst

[11] Patent Number: 4,996,536

[45] Date of Patent: Feb. 26, 1991

[54] RADAR REFLECTORS

[75] Inventor: Jeffrey C. Broadhurst, Branston, England

[73] Assignee: Woodville Polymer Engineering Limited, Ross-en-Wye, England

[21] Appl. No.: 424,235

[22] PCT Filed: Feb. 16, 1989

[86] PCT No.: PCT/GB89/00137

§ 371 Date: Oct. 19, 1989

§ 102(e) Date: Oct. 19, 1989

[87] PCT Pub. No.: WO89/07840

PCT Pub. Date: Aug. 24, 1989

[30] Foreign Application Priority Data

Feb. 19, 1988 [GB] United Kingdom ..... 8803871
Aug. 15, 1988 [GB] United Kingdom ..... 8819356.0

[51] Int. Cl.[5] ..... H01Q 15/20
[52] U.S. Cl. ..... 343/912; 342/7
[58] Field of Search ..... 343/912, 907, 916; 342/5, 7, 8, 10

[56] References Cited

U.S. PATENT DOCUMENTS 2,763,000 9/1956 Graham ..... 342/7
3,117,318 1/1964 Jones ..... 342/7
3,276,017 9/1966 Mullin ..... 342/8

FOREIGN PATENT DOCUMENTS 634701 1/1962 Canada ..... 342/8
8022692 11/1985 Fed. Rep. of Germany .
910444 11/1962 United Kingdom ..... 342/8

*Primary Examiner*—Michael C. Wimer
*Assistant Examiner*—HoangAnh Le
*Attorney, Agent, or Firm*—Young & Thompson

[57] ABSTRACT

An array of reflectors of electromagnetic waves comprising a plurality of trihedral reflectors (10 to 17) arranged about a vertical axis (21) with each reflector orientated about its major axis (22) so that the plane bisecting the angle between two panels (18) is vertical and with adjacent reflectors turned through 60 degrees about their major axes (22) relative to one another, characterised in that the reflectors (10 to 17) are tilted relative to said vertical axis (21) of the array with the adjacent sides (37) of adjacent reflectors diverging so that the major axes (22) of the reflectors are directed from the vertices (19) at the required angles of elevation. Preferably, the horizontal sides (24) of alternate reflectors (14 to 17) at the top terminate closely adjacent to corners of intermediate reflectors (10 to 13). The sides (37) of adjacent reflectors diverge towards the bottom to form triangular gaps (38) therebetween. Additional radar reflective panels (b 54) are provided in the gap (38) between the diverging sides of adjacent reflectors. Preferably, the array is supported in an inflatable support structure (25 to 33).

14 Claims, 3 Drawing Sheets

RADAR REFLECTORS

TECHNICAL FIELD

This invention relates to an array of reflectors of electromagnetic waves, especially radar.

Radar reflector arrays commonly employ trihedral reflectors which comprise three radar reflective planar panels with right-angled corners meeting at a vertex and each joined along two sides to the other two panels so that radar energy incident on the inner surfaces of the reflector is focused and re-directed back towards the source. Typically, the panels are isosceles triangles in shape and their unjoined sides define an equilateral triangular mouth to receive radar energy, this type of trihedral reflector being known as a deltatrihedral. The properties of trihedral reflectors are well known and include the ability to provide a reflective response over a cone of approximately 40 degrees centred on the major axis of the reflector, which is the intersection of the planes bisecting the angles between the panels.

It is known to provide a plurality of trihedral reflectors in an array about a central vertical axis so that the array covers the complete 360 degrees of azimuth for incident radar energy. These reflectors are arranged with the sides of their triangular mouths in edge to edge contact, adjacent reflectors being turned through 60 degrees about their major axes relative to one another so as to allow "nesting" of the reflectors. This construction has been considered advantageous because it is a solid form with its circumference totally occupied by reflectors in edge to edge contact for optimum reflective response. However, a geometrical consequence of this design is that the major axis of each reflector is fixed by the number of reflectors in the array, which limits its usefulness in many applications, for example, with radar reflectors intended to be observed from above.

DISCLOSURE OF THE INVENTION

According to the present invention an array of reflectors comprises a plurality of trihedral reflectors (as hereinbefore defined) arranged about a vertical axis of the array with the major axis of each reflector directed in a different direction from the vertical axis, with each reflector orientated about its major axis so that the plane bisecting the angle between two panels is vertical, and with adjacent reflectors turned through 60 degrees about their major axes relative to one another, characterised in that the reflectors are tilted relative to said vertical axis of the array with the adjacent sides of adjacent reflectors diverging so that the major axes of the reflectors are directed from the vertices at the required angles of elevation.

It will be appreciated that because each reflector is orientated with the plane bisecting the angle between two panels vertical, one side of the reflector either top or bottom will be horizontal, and because adjacent reflectors are turned through 60 degrees, the horizontal side is alternately top and bottom in successive reflectors. For compactness and to reduce the gaps between the reflectors for maximum reflective response, the horizontal sides in one plane, either top or bottom, are arranged with their adjacent ends closely spaced together in the form of a polygon with the tip of the intermediate reflector therebetween. The diverging sides of adjacent reflectors then define a triangular space therebetween.

The gaps between the diverging sides of adjacent reflectors may be filled with additional panels of radar reflective material to avoid reflection nulls in the array. In the compact array described above, these additional panels could be triangular panels.

For radar reflectors intended to be observed from above, the reflectors are tilted backwards at the top so that the major axes are directed above the horizontal. In the compact array described above, the sides at the top then form the polygon within the outline of the sides at the bottom as seen in plan view.

It should be appreciated that where the terms "vertical" and "horizontal" and "top" and "bottom" are used, these are to be understood in a relative sense and not to be taken as limitative of the actual orientation of the array as a whole.

DESCRIPTION OF THE DRAWINGS

The invention will now be described by way of example with reference to the accompanying drawings in which.

THE BEST MODE OF CARRYING OUT THE INVENTION

Figure 1:
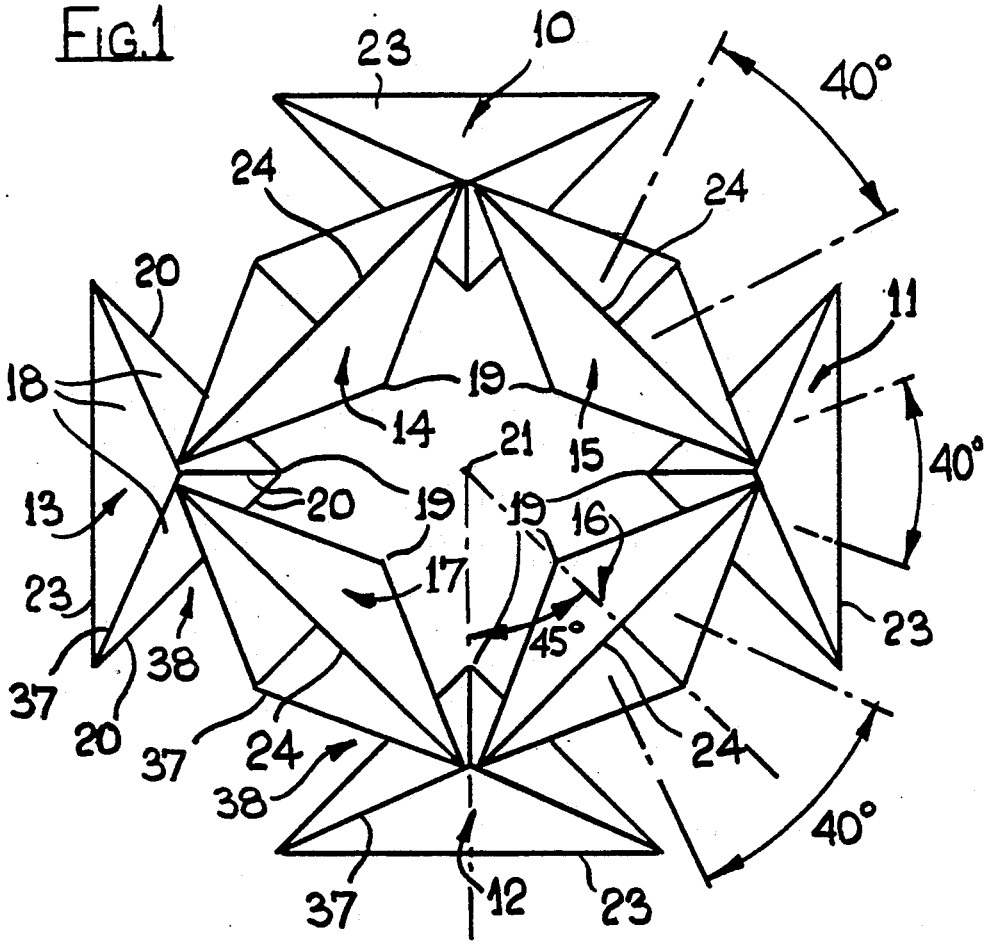
FIG. 1 is a plan view of an array of eight deltatrihedral reflectors according to one embodiment of the invention.
Figure 2:
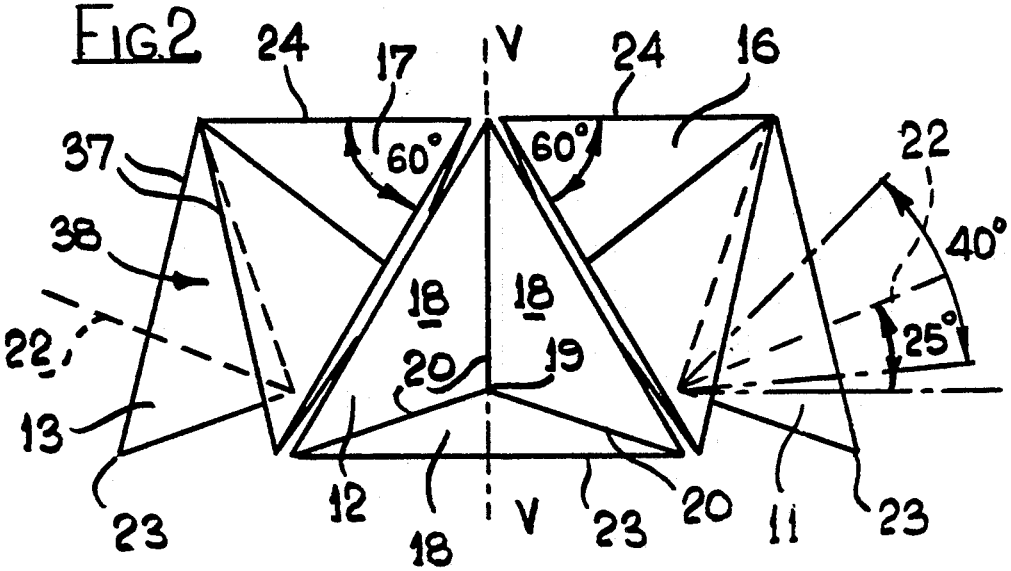
FIG. 2 is a side elevation of the array of FIG. 1.

The array illustrated in FIGS. 1 and 2 comprises eight deltatrihedral reflectors 10 to 17 each comprising three radar reflective planar panels 18 in the form of isosceles triangles with right-angled corners that are assembled with the right-angled corners meeting at a vertex 19 and with each panel joined along two sides 20 to the other two panels. Each reflector has a major axis 22 formed by the intersection of the planes bisecting the angles between the panels 18, and each reflector is orientated about this major axis 22 so that the plane V—V (FIG. 2) bisecting the angle between two panels 18 is vertical.

These reflectors are equi-angularly arranged about a vertical axis 21 of the array at intervals of 45 degrees. However, four of the reflectors 10, 11, 12 and 13 are arranged with one of the edges 23 of the mouth of the reflector horizontal on the sides of a square in a lower horizontal plane, and four of the reflectors 14, 15, 16, and 17 are interspaced with the reflectors 10, 11, 12, 13 and are arranged with one of the corresponding edges 24 of the mouth of the reflector horizontal on the sides of a square in an upper horizontal plane. Each of the reflectors 10 to 17 is therefore rotated through 60 degrees about its major axis relative to each adjacent reflector. Said upper and lower squares are offset 45 degrees relative to one another.

For compactness, the sides 24 of the upper square substantially meet at the upper corners of the four reflectors 10, 11, 12, 13, while the sides 23 on the lower square have their ends spaced apart and form a larger square than the upper square, as seen in plan view in FIG. 1. The adjacent sides 37 of adjacent reflectors therefore diverge from the top to the bottom leaving triangular gaps 38.

Each reflector is inclined rearwards from the vertical at the top so that its major axis is directed upwards from the vertex at an angle of elevation above the horizontal. In this way it is ensured that the array is effective in reflecting radar energy that is incident on it from above.

As shown in FIG. 2, the reflectors have an effective reflective cone with a cone angle of approximately 40 degrees, and the elevation of the major axis 22 at the centre of the cone is typically 25 degrees above the horizontal. However, if the reflectors are to be effective down to the horizontal, the angle of elevation should not be above 20 degrees.

Figure 3:
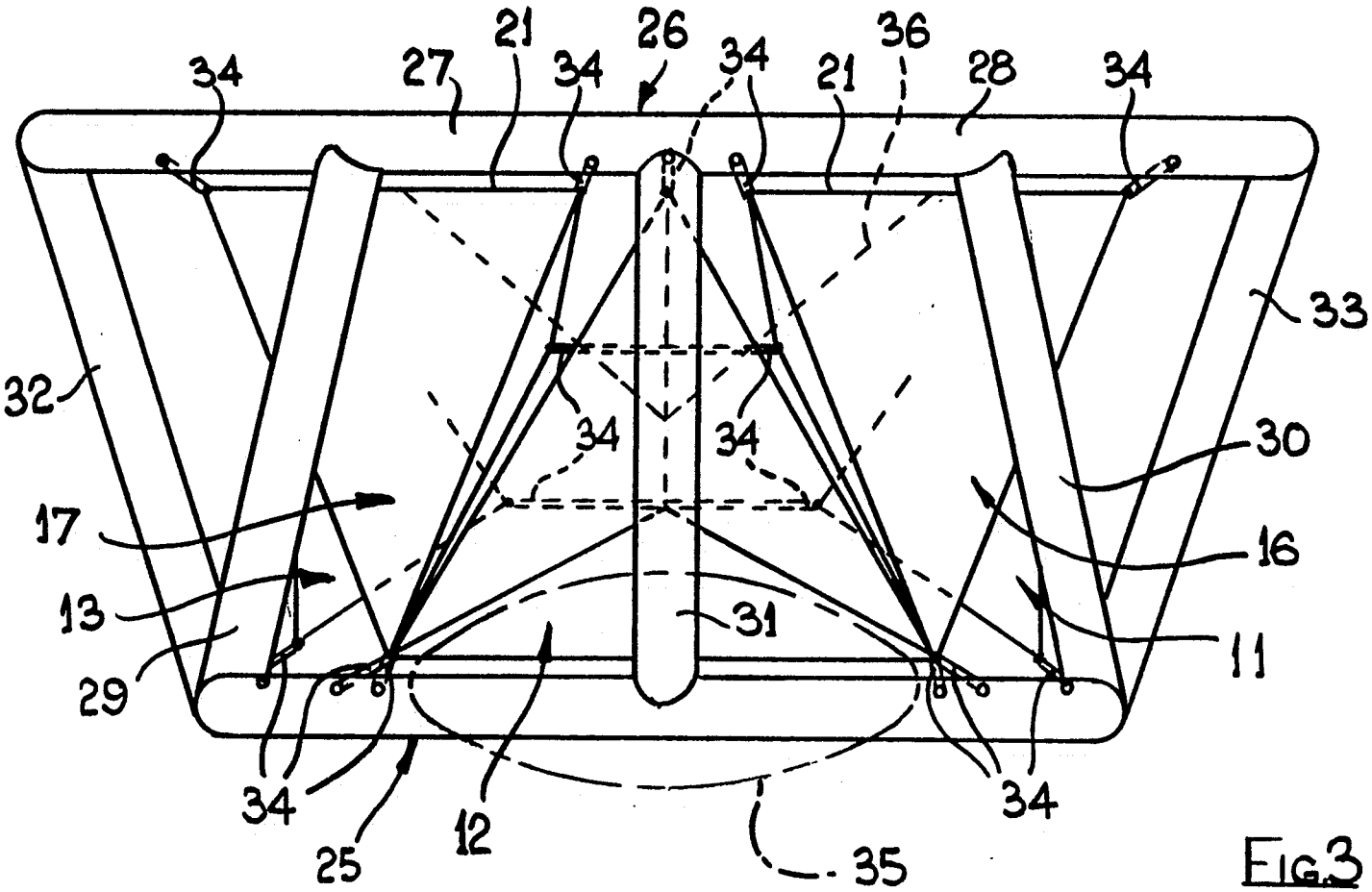
FIG. 3 is a side elevation of an inflatable support structure as used to support the array of FIGS. 1 and 2.

FIG. 3 shows an inflatable support structure that is suitable to support the array of FIGS. 1 and 2. The support structure is made up of tubular elements and comprises a bottom square frame 25 of which one side only is visible in FIG. 3, and a top square frame 26 which is of the same dimensions as the bottom frame but is turned through 45 degrees so that two sides 27 and 28 of the frame are visible in FIG. 3, meeting at the centre. Each corner of the lower frame 25 is joined to the middle of the corresponding side of the upper frame 26 by a tubular strut and each corner of the upper frame is joined to the middle of the corresponding side of the lower frame by a tubular strut. Thus struts 29 and 30 join the corners of frame 25 to the middle of sides 27 and 28, respectively, while struts 31, 32 and 33 join corners of the upper frame 26 to the sides of the lower frame 25.

Preferably, the reflectors are made of flexible electrically conducting sheet material so that the whole assembly can be erected rapidly from a compact pack simply by inflating the support structure. Materials which can be used include metallized fabrics and materials woven with metallic fibres. Adjustable elastic or spring tensioning devices 34 preferably attach the reflectors to the support structure to ensure that the reflectors are held taut with their surfaces 18 flat and orthogonal to one another once erected. The tensioning devices 34 connected to the vertices 19 of each of the two sets of reflectors 10 to 13 and 14 to 17 are interconnected at the centre of the array, as shown in FIG. 3.

FIG. 3 also shows a bouyancy bag 35 attached to the support structure, and the possibility of providing an additional reflector 36 which points directly upwards, with its mouth lying in a horizontal plane.

The array of reflectors of FIGS. 1 and 2 can be modified by the addition of triangular panels in the gaps 38 between the adjacent sides 37 of adjacent reflectors so as to avoid reflective nulls in these gaps. These additional triangular panels would also be composed of radar reflective material in a collapsible array.

Figure 4:
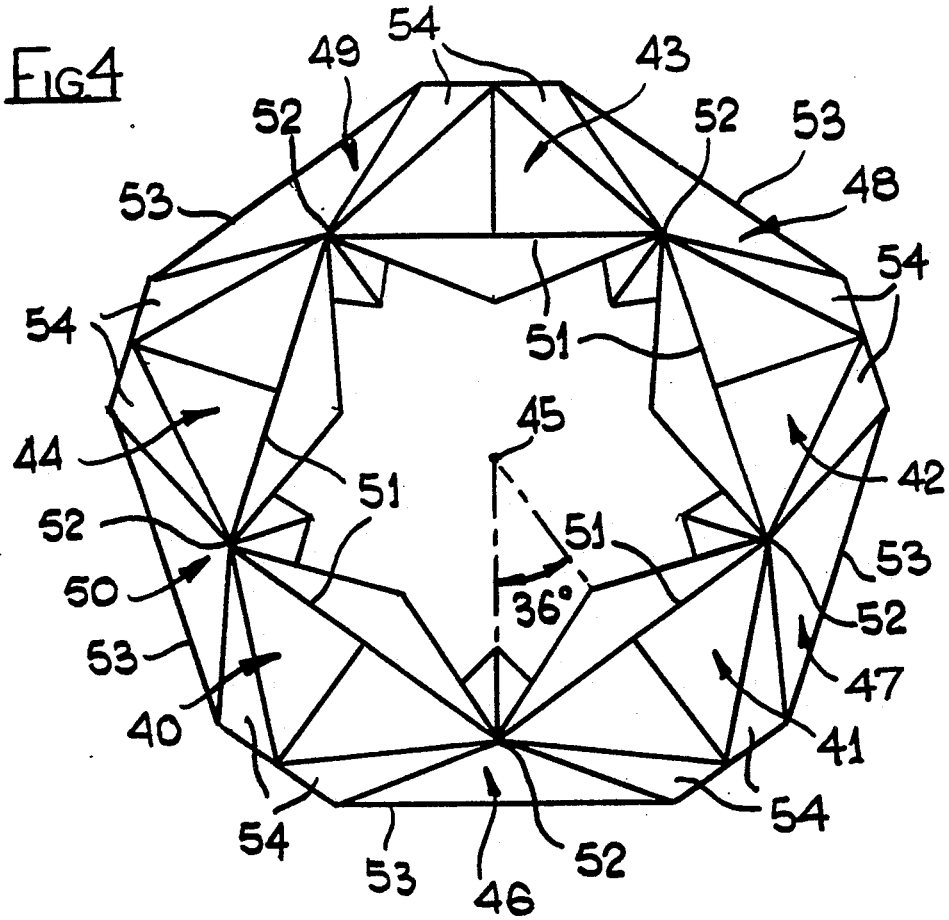
FIG. 4 is a plan view of an array of ten deltatrihedral reflectors according to a second embodiment of the invention.
Figure 5:
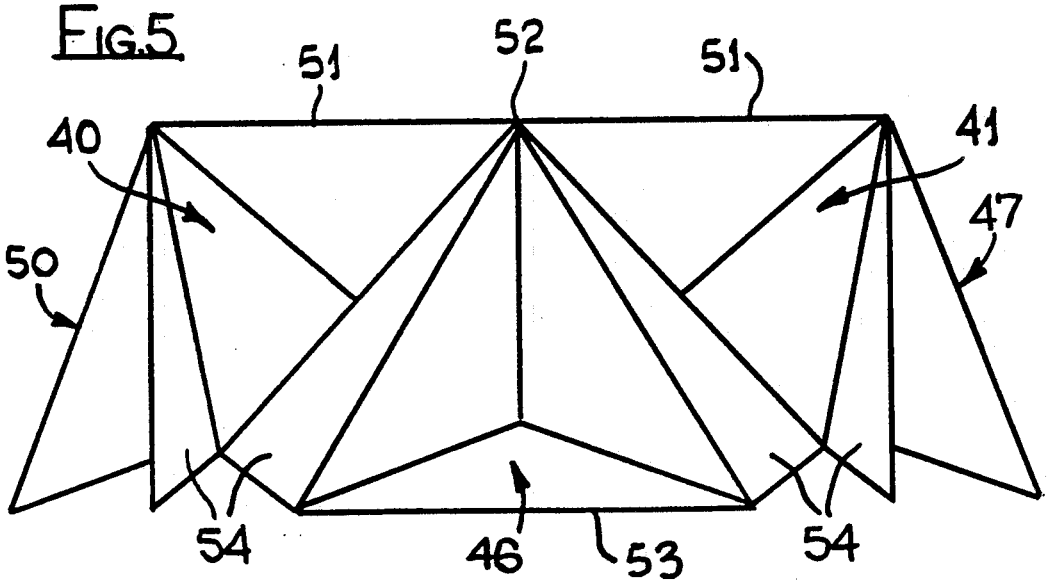
FIG. 5 is a side elevation of the array of FIG. 4.

FIGS. 4 and 5 illustrate an array of ten deltatrihedral reflectors arranged in a similar manner to the embodiment of FIGS. 1 and 2 except that five reflectors 40 to 44 are arranged with sides 51 at the top horizontal and terminating closely adjacent one another with the corners 52 of intermediate reflectors therebetween to form a pentagon. The sides 53 of the five intermediate reflectors 46 to 50 at the bottom are horizontal and lie along the sides of a pentagon which is rotated 36 degrees relative to that at the top, see FIG. 4. The reflectors are all inclined rearwards towards the central vertical axis 45 of the array at the top so that the major axes of the reflectors are all inclined at an angle of elevation above the horizontal.

The array of FIGS. 4 and 5 is shown with triangular panels 54 located in the downwardly diverging gaps between the adjacent sides of adjacent reflectors so as to avoid reflective nulls.

It will be appreciated that the array of reflectors of FIGS. 4 and 5 can be supported in an inflatable support structure similar to that shown in FIG. 3, and each reflector and the additional panels 54 can be composed of flexible radar reflective material.

I claim:

1. An array of reflectors of electromagnetic waves comprising a plurality of trihedral reflectors each comprising three radar reflective panels with right-angled corners meeting at a vertex and each panel meeting the other two panels along two sides leaving a third side defining a triangular opening with a major axis detected outwards from said vertex through said opening and defined by the intersection of planes normal to and bisecting said panels, said plurality of trihedral reflectors being arranged about a vertical axis with said major axis of each reflector directed outwards and upwardly away from said vertical axis and with a said third side of alternate reflectors disposed uppermost and arranged horizontally and a said third side of intermediate alternate reflectors disposed lowermost and arranged horizontally, and additional radar reflective panels each disposed between the triangular openings of adjacent reflectors and bridging between adjacent downwardly diverging said third sides of panels of said reflectors.

2. An array as claimed in claim 1 in which each reflector (10 to 17) is a deltatrihedral.

3. An array as claimed in claim 1 in which said uppermost horizontal third sides (24) of alternate reflectors (14 to 17) terminate closely adjacent to corners of intermediate reflectors (10 to 13) so that said third sides (37) of adjacent reflectors that diverge downwardly form triangular gaps (38) therebetween occupied by said additional panels which have a corresponding triangular shape.

4. An array as claimed in claim 1 in which the major axes (22) of the reflectors (10 to 17) are equi-angularly spaced around the whole 360° about the vertical axis (21) of the array.

5. An array as claimed in claim 1 comprising ten reflectors (40 to 44, 46 to 50) with the major axes (22) displaced 36° apart around the vertical axis (21) of the array.

6. An array as claimed in claim 1 in which the major axes (22) are all inclined at substantially the same angle of elevational above the horizontal.

7. An array as claimed in claim 6 in which said angle of elevation is greater than 20° above the horizontal.

8. An array as claimed in claim 1 in which the reflectors are supported by an erectable support structure comprising frame members (25, 26, 29 to 33).

9. An array as claimed in claim 8 in which the frame members are inflatable and comprise top and bottom tubular frames (25, 26) interconnected by struts (29 to 33) with the array of reflectors supported within said structure.

10. An array as claimed in claim 9 in which the frames (25, 26) are both polygons with the same number of sides equal to half the number of reflectors in the array so that each side of each polygon extends alongside a corresponding side (51, 53) of a reflector.

11. An array as claimed in claim 10 in which the two frames (25, 26) are both polygons of the same overall dimensions.

12. An array as claimed in claim 1 in which the panels (18) of the reflectors are composed of a flexible electrically conductive sheet material which is tensioned to assume flat orthogonal panels.

13. An array as claimed in claim 12 in which resilient tensioning means (34) is provided to tension the sheet material of the reflectors.

14. An array as claimed in claim 1 which includes a trihedral reflectors (36) arranged with its major axis (22) aligned with the vertical axis (21) of the array.

* * * * *